US009395091B2

(12) United States Patent
Zank et al.

(10) Patent No.: US 9,395,091 B2
(45) Date of Patent: Jul. 19, 2016

(54) FOOD SERVICE UNIT INCLUDING RECIRCULATING VENTILATION SYSTEM AND FIRE SUPPRESSION SYSTEM

(71) Applicant: The Vollrath Company, L.L.C., Sheboygan, WI (US)

(72) Inventors: Jeffrey T. Zank, Germantown, WI (US); John Wojcik, Sheboygan, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 196 days.

(21) Appl. No.: 13/831,264

(22) Filed: Mar. 14, 2013

(65) Prior Publication Data

US 2014/0020673 A1 Jan. 23, 2014

Related U.S. Application Data

(60) Provisional application No. 61/674,627, filed on Jul. 23, 2012.

(51) Int. Cl.

| | |
|---|---|
| ***A62C 13/62*** | (2006.01) |
| ***F24C 15/20*** | (2006.01) |
| ***A62C 31/02*** | (2006.01) |
| ***A62C 3/00*** | (2006.01) |
| ***A62C 37/40*** | (2006.01) |

(52) U.S. Cl.

CPC ..... *F24C 15/2021* (2013.01); *A62C 3/006* (2013.01); *A62C 31/02* (2013.01); *A62C 37/40* (2013.01); *F24C 15/2042* (2013.01)

(58) Field of Classification Search

CPC ..... A62C 3/00; A62C 3/006; A62C 2/06; A62C 2/10

USPC ..... 169/65, 60, 16, 20, 48, 49; 239/68, 69

See application file for complete search history.

(56) References Cited

U.S. PATENT DOCUMENTS 4,489,647 A * 12/1984 Stamps et al. ..... 99/336
4,580,638 A * 4/1986 Jones ..... A62C 3/04 169/49
4,766,880 A 8/1988 Von Blanquet (Continued)

OTHER PUBLICATIONS

American Hood Systems, Inc., Ventless Exhaust Hood System Model AVH23, undated, Mar. 14, 2012 is earliest known date of availability, 2 pages.

(Continued)

*Primary Examiner* — Davis Hwu
(74) *Attorney, Agent, or Firm* — Foley & Lardner LLP

(57) ABSTRACT

A food service unit for use with a cooking unit includes a food shield including an upper wall, a customer-side wall, and two lateral sidewalls, a ventilation volume defined at least in part by the food shield, a recirculating ventilation system including a filter, a fan downstream of the filter, and an exhaust vent, wherein the fan is configured to draw air from the ventilation volume through the filter and exhaust the air through the exhaust vent, a pressure sensor configured to detect a differential pressure between atmosphere and a location between the filter and the fan, a control system configured to prevent a cooking unit from operating when the detected differential pressure is outside a specified range of pressures, a fire suppression system including a nozzle and a source of fire extinguishing agent and a fire detection sensor configured to detect a fire and activate the fire suppression system.

19 Claims, 4 Drawing Sheets

(56) References Cited

U.S. PATENT DOCUMENTS

| | | | | |
|---|---|---|---|---|
| 4,934,337 | A | 6/1990 | Falk | |
| 6,604,520 | B2 | 8/2003 | Grimm et al. | |
| 7,681,655 | B2 | 3/2010 | Biehl | |
| 7,687,748 | B2 | 3/2010 | Gagas | |
| 2006/0278216 | A1* | 12/2006 | Gagas et al. | 126/299 D |
| 2007/0062513 | A1 | 3/2007 | Gagas | |
| 2007/0295324 | A1 | 12/2007 | Feisthammel et al. | |
| 2008/0029081 | A1 | 2/2008 | Gagas et al. | |
| 2009/0137201 | A1 | 5/2009 | Huber et al. | |
| 2009/0194299 | A1 | 8/2009 | Neumann et al. | |
| 2009/0229473 | A1 | 9/2009 | Vidojevic et al. | |
| 2009/0241934 | A1 | 10/2009 | Canavari | |
| 2010/0012110 | A1 | 1/2010 | Feisthammel et al. | |
| 2010/0059040 | A1 | 3/2010 | Shaffer et al. | |
| 2011/0308825 | A1* | 12/2011 | Lee | 169/65 |

OTHER PUBLICATIONS

Equipex Ltd., SA Vent Concept, undated, Mar. 14, 2012 is earliest known date of availability., 2 pages.

Spring USA, Induction Cooking Built-In, undated, Mar. 14, 2012 is earliest known date of availability, 2 pages.

* cited by examiner

FOOD SERVICE UNIT INCLUDING RECIRCULATING VENTILATION SYSTEM AND FIRE SUPPRESSION SYSTEM

CROSS-REFERENCE TO RELATED PATENT APPLICATIONS

This application claims the benefit of U.S. Provisional Application No. 61/674,627, filed Jul. 23, 2012, which is incorporated herein by reference in its entirety.

BACKGROUND

The present invention relates generally to the field of food service units. In particular, the present invention relates to food service units including fire suppression systems and recirculating ventilation systems.

SUMMARY

One embodiment of the invention relates to a food service unit for use with a cooking unit. The food service unit includes a food shield including an upper wall, a customer-side wall, and two lateral sidewalls, wherein the customer-side wall and the two sidewalls are arranged in a U-shape and the upper wall is coupled to upper portions of the customer-side wall and the two sidewalls, a ventilation volume defined at least in part by the food shield, a recirculating ventilation system including a filter, a fan downstream of the filter, and an exhaust vent, wherein the fan is configured to draw air from the ventilation volume through the filter and exhaust the air through the exhaust vent, a pressure sensor configured to detect a differential pressure between atmosphere and a location between the filter and the fan, a control system configured to prevent a cooking unit from operating when the detected differential pressure is outside a specified range of pressures, a fire suppression system including a nozzle and a source of fire extinguishing agent, wherein the nozzle is coupled to the upper wall, and a fire detection sensor configured to detect a fire and activate the fire suppression system when a fire is detected such that, upon activation of the fire suppression system, the extinguishing agent is dispensed through the nozzle.

Another embodiment of the invention relates to a food service unit including a cabinet, a cooking unit, a food shield including an upper wall, a customer-side wall, and two lateral sidewalls, wherein the customer-side wall and the two sidewalls are arranged in a U-shape, the upper wall is coupled to upper portions of the customer-side wall and the two sidewalls, and lower portions of the customer-side wall and the two sidewalls are coupled to the cabinet, a ventilation volume defined between the food shield and the cabinet, a recirculating ventilation system including a filter, a fan downstream of the filter, and an exhaust vent, wherein the fan is configured to draw air from the ventilation volume through the filter and exhaust the air through the exhaust vent, a pressure sensor configured to detect a differential pressure between atmosphere and a location between the filter and the fan, a control system configured to prevent the cooking unit from operating when the detected differential pressure is outside a specified range of pressures, a fire suppression system including a nozzle and a source of fire extinguishing agent, wherein the nozzle is coupled to the upper wall, and a fire detection sensor configured to detect a fire and activate the fire suppression system when a fire is detected such that, upon activation of the fire suppression system, the extinguishing agent is dispensed through the nozzle.

Another embodiment of the invention relates to a food service unit for use with a cooking unit. The food service unit includes a food shield that defines a ventilation volume adjacent the cooking unit, a recirculating ventilation system including a filter, a fan downstream of the filter, and an exhaust vent, wherein the fan is configured to draw air from the ventilation volume through the filter and exhaust the air through the exhaust vent, a pressure sensor configured to detect a differential pressure between atmosphere and a location between the filter and the fan, a control system configured to prevent the cooking unit from operating when the detected differential pressure is outside a specified range of pressures, a fire suppression system including a nozzle and a source of fire extinguishing agent, wherein the nozzle is coupled to the upper wall, and a fire detection sensor configured to detect a fire and activate the fire suppression system when a fire is detected such that, upon activation of the fire suppression system, the extinguishing agent is dispensed through the nozzle.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
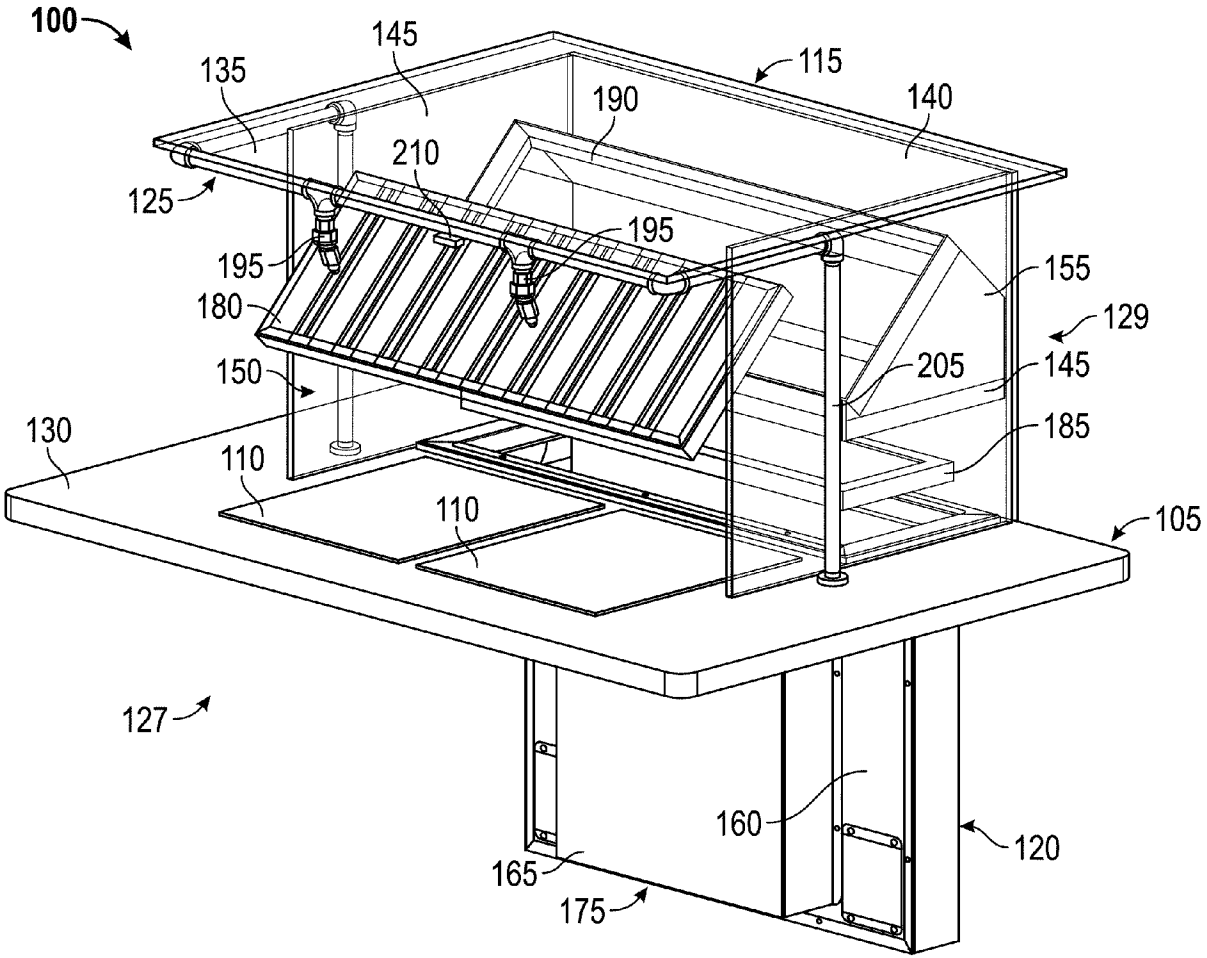
FIG. 1 is a partially exploded front perspective view of a food service unit according to an exemplary embodiment.
Figure 2:
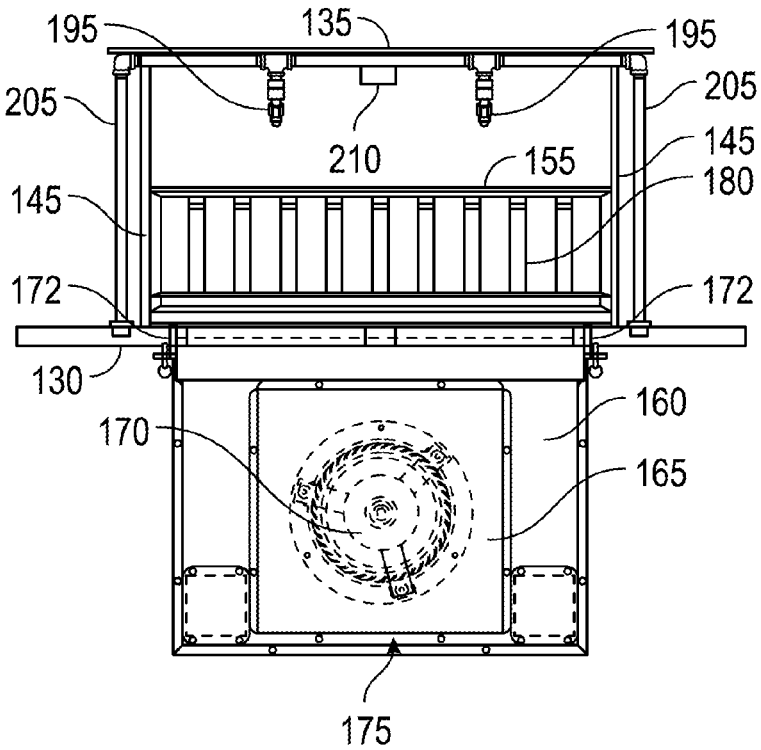
FIG. 2 is a front view of the food service unit of FIG. 1.

Referring to FIGS. 1-2, a food service unit 100 according to an exemplary embodiment is shown. The food service unit 100 includes a cabinet 105, one or more cooking units 110, a food shield 115, a recirculating ventilation system 120, and a fire suppression system 125. The food shield 115 separates the customer from the cooking units 110. The recirculating ventilation system 120 provides ventilation for the cooking units 110 to remove cooking effluent (e.g., fumes, steam, smoke, grease, particulates, or other matter) from the ventilation volume. The fire suppression system 125 suppresses any unwanted fires that may occur on or in the cooking units 110, in the interior of the food shield 115, or in the recirculating ventilation system 120. The cooking unit 110 also includes a chef side 127 and a customer side 129. The chef side 127 is the side closest to the cooking units 110 so that a chef can make use of the cooking units 110. The customer side 129 is opposite the chef side 127.

The cabinet 105 includes a countertop 130, four sidewalls and a bottom. For clarity, the four sidewalls and the bottom are not illustrated. The countertop 130 supports the cooking units 110, the food shield 115 and portions of the recirculating ventilation system 120. In some embodiments, the food service unit 100 can be sold as a package including the cabinet 105. In other embodiments, the cabinet 105 is sold separately from the other components of the food service unit 100.

The cooking units 110 can be gas, electric, or induction ranges, fryers, or other cooking devices. The cooking units 110 may be coupled to the countertop 130 or positioned on/in the countertop 130 (e.g., as a drop-in unit). In some embodiments, the food service unit 100 can be sold as a package including the cooking units 110. In other embodiments, the cooking units 110 are sold separately from the other components of the food service unit 100.

The food shield 115 includes a top or upper wall 135, a customer-side wall 140, and two sidewalls 145. The upper wall 135, the customer-side wall 140, and the two sidewalls 145 provide a barrier between the customer and the food, which is sometimes generally referred to as a "sneeze" or "breath" guard. The customer-side wall 140 and the two sidewalls 145 are arranged in a U-shape topped by the upper wall 135 so that the food shield 115 opens toward the chef side 127 with the customer-side wall 140 positioned toward the customer side 129. Each sidewall 145 extends from an end of the customer-side wall 140. The upper wall 135 is coupled to upper portions of the customer-side wall 140 and the two sidewalls 145 and overhangs each of the customer-side wall 140 and the sidewalls 145. In an exemplary embodiment, the upper wall 135, the customer-side wall 140 and the two sidewalls 145 are flat and made of tempered glass. Alternatively, these components can be curved and/or made of other fireproof materials (e.g., ceramic). The food shield 115 is coupled to the countertop 130 such that lower portions of the customer-side wall 140 and the sidewalls 145 engage the countertop 130. The food shield 115 is self-supporting or, alternatively, at least a portion of the food shield 115 can be supported by a portion of the fire suppression system 125.

A ventilation volume 150 is the space from which the recirculating ventilation system 120 draws air. The ventilation volume 150 is generally defined between the food shield 115 and the countertop 130. The ventilation volume 150 can and likely does extend beyond the bounds of the food shield 115 and the countertop 130. However, the space defined between the food shield 115 and the countertop 130 is the primary space targeted for ventilation by the recirculating ventilation system 120.

Figure 3:
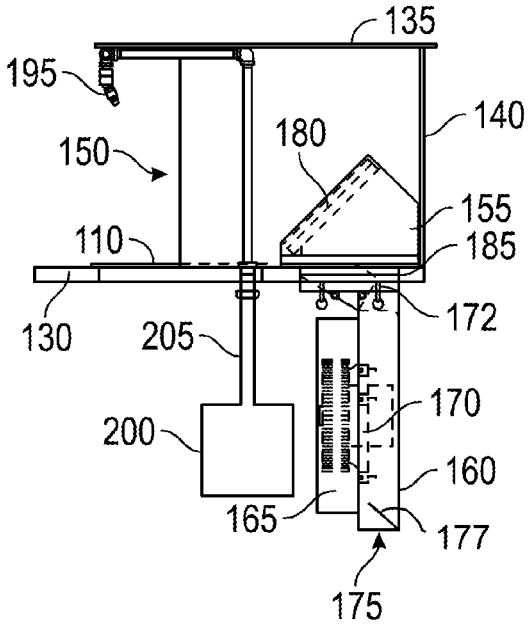
FIG. 3 is a side view of the food service unit of FIG. 1.

Referring to FIGS. 1-3, the recirculating ventilation system 120 includes an intake shroud 155, a vent duct 160, a fan housing 165, and a fan 170 (FIG. 2). The intake shroud 155 is positioned inside the food shield 115 and couples to the vent duct 160 so that the vent duct 160 is fluidly downstream from the intake shroud 155. In an exemplary embodiment, the intake shroud 155 is not secured to the vent duct 160 (e.g., with fasteners or otherwise). The intake shroud 155 includes an inlet and an outlet.

The vent duct 160 is fluidly connected between the intake shroud 155 and the fan housing 165. The vent duct 160 extends through an opening in the countertop 130 into the interior of the cabinet 105. A pair of U-shaped clamps 172 (FIGS. 2-3) are positioned along two opposite sides that define the opening in the countertop 130. The clamps 172 are secured to the countertop 130 by thumb screws or other appropriate fasteners. The vent duct 160 is then secured to the two clamps 172. The vent duct 160 includes an inlet and an outlet.

The fan housing 165 includes an exhaust vent 175. In an exemplary embodiment, the exhaust vent 175 is oriented down, but can be oriented to the side to face either left or right, as needed. The fan 170 is positioned inside the fan housing 165 and is operable to draw air from the ventilation volume 150 into the intake shroud 155, through the vent duct 160, into the fan housing 165, and exhaust the air through the exhaust vent 175. The exhaust vent 175 may include a damper 177 to close the exhaust vent 175 to inhibit any unwanted fire from exiting the recirculating ventilation system 120 via the exhaust vent 175. In some embodiments, the damper 177 is biased to a closed position (i.e., normally closed) and moves to an open position when the recirculating ventilation system 120 is on. The damper 177 can be biased to a normally closed position by a spring or a solenoid. In an exemplary embodiment, the damper 177 opens and closes the exhaust vent 175. In some embodiments, the damper 177 is biased to the closed position and held open by a mechanical thermal link. Such a link destructively melts when exposed to a temperature above a threshold temperature (e.g., 165° Fahrenheit), thereby allowing the damper to move to the closed position. In some embodiments, the damper 177 or additional similar dampers are located elsewhere within the recirculation ventilation system 120 (e.g., downstream of the fan 170 and upstream of the exhaust vent 175, upstream of the fan 170, downstream of the filters, upstream of the filers, etc.).

The food shield 115 is integral to the proper functioning of the recirculating ventilation system 120. By containing the cooking effluent, the food shield 115 allows the recirculating ventilation system 120 to draw the cooking effluent along with air from the ventilation volume 150 through the recirculating ventilation system 120 across an air intake area also defined by the food shield 115. Also, the food shield 115 assists fire containment by providing a physical barrier and by providing a structure to support installation of components of the fire suppression system 125. The food shield 115 must be of an appropriate shape and size for the recirculating ventilation system 120 to work as intended.

The recirculating ventilation system 120 also includes a grease filter 180 and a particulate filter 185. The grease filter 180 is removable from the intake shroud 155 and is positioned in the inlet of the intake shroud 155. The grease filter 180 is supported by a rim or shelf 190 (FIG. 1) to couple the grease filter 180 to the intake shroud 155. According to an exemplary embodiment, the grease filter 180 is not secured with a fastener, but may, alternatively, be secured to the intake shroud 155 by a clip, clamp, latch, or other easily-released securing device. The grease filter 180 may be easily washable by hand or in a dishwasher. By making the grease filter 180 easy to remove and readily visible to the chef by positioning it in the inlet of the intake shroud 155, the likelihood of the grease filter 180 being removed for regular cleaning or replacement is increased. By positioning the grease filter 180 upstream (i.e., the first filter contacted by the flow through the recirculating ventilation system 120), the likelihood of grease reaching the downstream portions of the recirculating ventilation system 120 (e.g., the vent duct 160, the fan housing 165, and the fan 170) is reduced, which reduces the chances of a grease fire starting or propagating downstream of the grease filter 180.

The particulate filter 185 is positioned downstream from the grease filter 180 at the inlet of the vent duct 160. The particulate filter 185 is supported by a rim or shelf to couple the particulate filter 185 to the vent duct 160. In an exemplary embodiment, the particulate filter 185 is not secured with a fastener, but may, alternatively, be secured to the vent duct 160 by a clip, clamp, latch, or other easily-released securing device. By making the particulate filter 185 easy to remove, the likelihood of the particulate filter 185 being removed for regular cleaning or replacement is increased.

The recirculating ventilation system 120 may also include a charcoal filter 192. The charcoal filter 192 is positioned downstream from the particulate filter 185. In one exemplary embodiment, the charcoal filter 192 is positioned underneath the particulate filter 185 in a stacked arrangement. The charcoal filter 192 is used to remove odors from the air and cooking effluent being moved through the recirculating ventilation system 120. Proper installation of the filters 180, 185, and 192 is aided by matching the mechanical design and size (length, width, height, etc.) of the filters 180, 185, 192 to the mechanical design and size of installation point of the filter (i.e., the rim or shelf 190 shown in FIG. 1 for supporting the grease filter 180).

Figure 4:
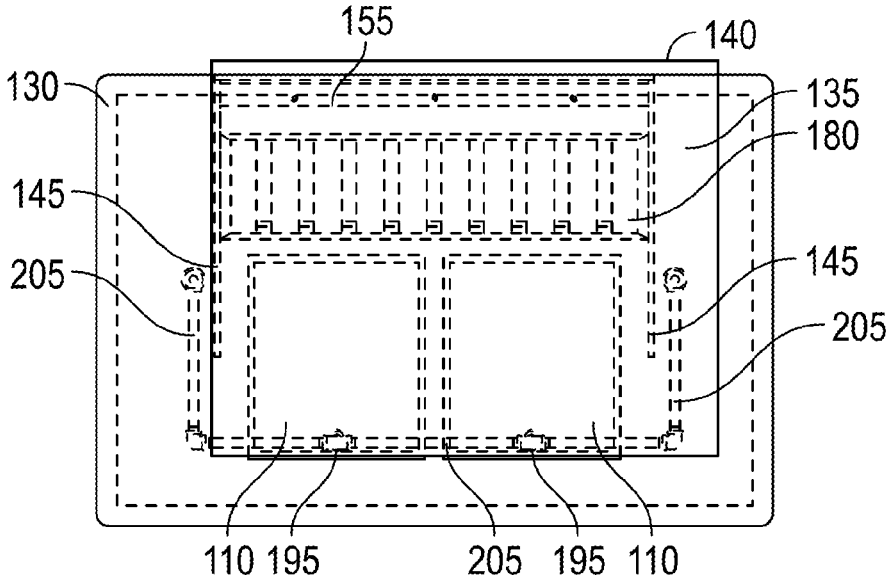
FIG. 4 is a top view of the food service unit of FIG. 1.
Figure 5:
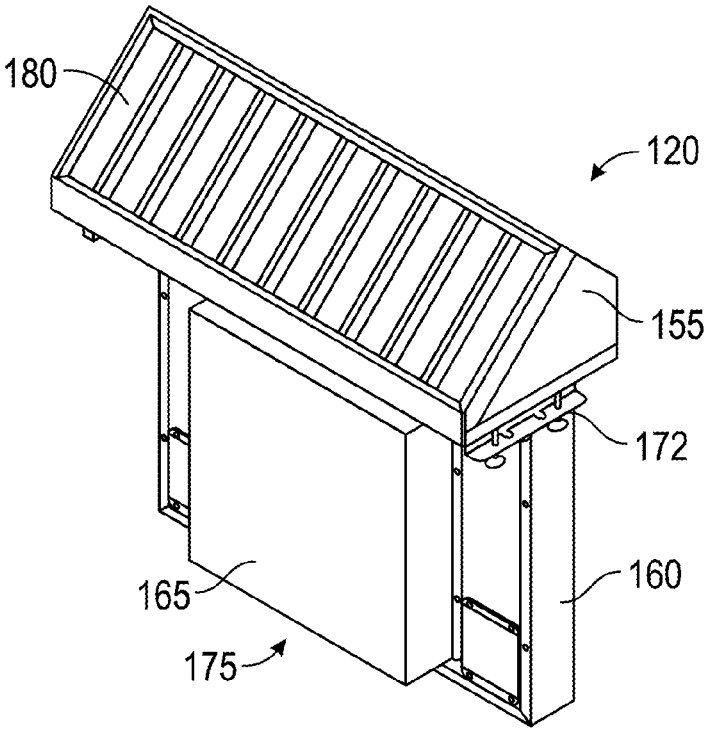
FIG. 5 is a front perspective view of a recirculating ventilation system of the food service unit of FIG. 1.

As shown in FIG. 4, in use, the cooking unit 110 produces cooking effluent that flows into the ventilation volume 150. The fan 170 draws air and cooking effluent from the ventilation volume 150 through the recirculating ventilation system 120. The air and cooking effluent first pass through grease filter 180 into the intake shroud 155. The grease filter 180 removes grease and other items from the air and cooking effluent. The air and cooking effluent travel through the intake shroud 155, pass through the particulate filter 185 and the charcoal filter 192 and enter the vent duct 160. The particulate filter 185 removes water vapor, particulates, and other items from the air and cooking effluent. The charcoal filter 192 removes odors from the air and cooking effluent. The air and cooking effluent then enter the fan housing 165 and finally exit the fan housing through the exhaust vent 175.

Figure 6:
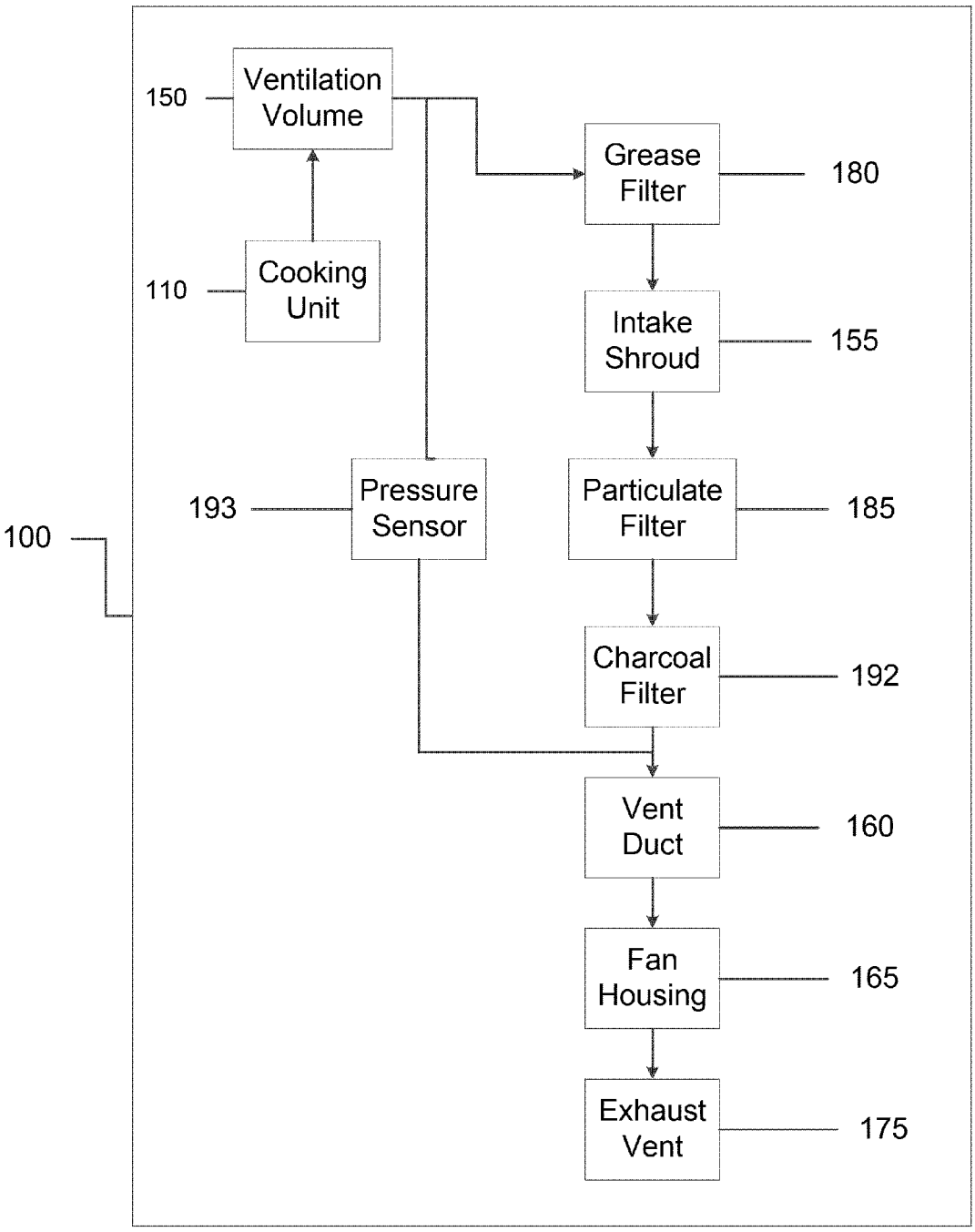
FIG. 6 is a schematic diagram of the flow of air and cooking effluent through the food service unit of FIG. 1.

According to an exemplary embodiment, the recirculating ventilation system 120 may include an interlock or control system designed to prevent activation of the cooking units 110. In one embodiment, the interlock prevents activation of the cooking unit 110 unless the intake shroud 155, the grease filter 180, the particulate filter 185, and the charcoal filter 192 are properly installed. In another embodiment, the interlock also prevents activation of the cooking units if the one or more of the filters 180, 185, and 192 are not sufficiently clean (i.e., at a prescribed level of cleanliness) to allow operation of the cooking units 110. In other embodiments, not all of the filters 180, 185, and 192 are interlocked, for example, only the grease filter 180 could be interlocked. The interlock can include one or more differential pressure sensors or switches (shown in FIG. 6) configured to detect a pressure difference between two locations.

As illustrated, a differential pressure sensor 193 detects the difference in pressure between a location downstream of the filters 180, 185, and 192 and upstream of the intake of the fan 170 and atmosphere (e.g., the ventilation volume 150). This arrangement detects when at least one of the filters 180, 185, 192 is missing (i.e., when a specified minimum pressure differential is detected by the differential pressure sensor 193), detects when the intake shroud 155 is properly installed, and/or detects when the filters 180, 185, and 192 are properly installed and at least one of the filters 180, 185, and 192 is insufficiently clean (i.e., when a specified maximum pressure differential is detected by the differential pressure sensor). The interlock allows the cooking units 110 to operate when the differential pressure sensor 193 detects a differential pressure within a specified (e.g., predetermined, prescribed, etc.) range between the specified minimum pressure differential (e.g., indicating low air flow) and the specified maximum pressure differential (e.g., indicating an air-flow blockage). In some embodiments, the specified minimum pressure differential is −0.1 inches of water of static pressure and the specified maximum pressure differential is −0.5 inches of water of static pressure, so that the interlock allows the cooking units 110 and/or the fan 170 to operate so long as the pressure differential is between −0.1 and −0.5 inches of water. When the detected pressure is within the specified range, the interlock will allow the cooking units 110 to operate. A pressure difference outside of this specified range indicates that at least one of the intake shroud 155 and the filters 180, 185, and 192 is not properly installed or that at least one of the filters 180, 185, and 192 is not sufficiently clean (e.g., outside a specified level of cleanliness). When the detected pressure difference is outside the specified range, the interlock will not allow the cooking units 110 to be activated. The interlock may also include a timer that allows the recirculating ventilation system 120 to run for a predetermined amount of time (e.g., 30 seconds) before checking the pressure sensor 193 to provide sufficient time for the recirculating ventilation system 120 to develop the detected pressure within the specified range. Alternately, the interlock can include multiple differential pressure sensors (e.g., three differential pressure sensors, with each configured to detect the differential pressure across one of the filters 180, 185, and 192) to detect a pressure difference between different location across the recirculating ventilation system 120. In some embodiments, the interlock includes two pressure switches. The low pressure switch is configured to detect pressures below the specified minimum pressure differential as described above and the high pressure switch is configured to detect pressures above the specified maximum pressure differential as described above. An indicator (e.g., light, LED, audible alarm, etc.) can be activated when high pressure is detected to alert a user to a high pressure condition. An indicator (e.g., light, LED, audible alarm, etc.) can be activated when low pressure is detected to alert a user to a low pressure condition. In some embodiments, the indicators for the high and low pressure conditions are activated instead of preventing activation of the cooking units 110.

Alternately or additionally, the interlock includes at least one airflow sensor to detect a rate, volume, or both rate and volume of airflow through the recirculating ventilation system 120. The airflow sensor would be used in a manner similar to the differential pressure sensor to determine when at least one of the filters 180, 185, 192 is missing and when the intake shroud 155 and the filters 180, 185, and 192 are properly installed and at least one of the filters 180, 185, and 192 is insufficiently clean.

Alternately or additionally, the interlock includes multiple switches with each switch associated with one of the intake shroud 155 and the filters 180, 185, and 192. When properly installed, each of the intake shroud 155 and the filters 180, 185, and 192 engages the associated switch. The interlock only allows the cooking units 110 to be activated when all of the switches are engaged. The switches can be mechanical, electrical, or magnetic switches or other types of presence-detecting switches. In some embodiments, the interlock is a hard-wired, relay-based control system. In other embodiments, the interlock is a control system implemented by a controller, computer, or processing circuit.

Referring to FIGS. 1-2, the fire suppression system 125 includes two nozzles 195, a tank 200 (FIG. 2) or other source of an extinguishing agent, and conduits 205 (e.g., pipes, tubes, ducts, passages, conduit members, etc.) that connect the two nozzles 195 to the tank 200. The nozzles 195 are coupled to the upper wall 135 and are directed towards the cooking units 110 and the intake shroud 155. The nozzles 195 are positioned on the chef side of the upper wall 135. Alternatively, more or fewer nozzles 195 can be included in the fire suppression system 125. The food shield 115 is intended to contain a fire so that the fire is limited at a known specific location (i.e., within the food shield 115) that can be targeted by the fire suppression system 125 and inhibited from spreading beyond the bounds defined by the food shield 115.

Referring to FIG. 2, the tank 200 stores the extinguishing agent. The extinguishing agent can be a dry chemical, foam, gas, or other appropriate material for extinguishing a fire. In an exemplary embodiment, the tank 200 is positioned inside the cabinet 105.

The fire suppression system 215 is integrated with the food shield 115 so that the nozzles 195 and the conduits 205 are not easily visible to the customer or chef (e.g., users of the food service unit 100). According to an exemplary embodiment, conduits 205 also serve as the support structure for at least one of the upper wall 135, the customer-side wall 140, and the sidewalls 145. Referring to FIGS. 1-2, the conduits 205 form a frame that supports at least a portion of the food shield 115. For example, the frame of conduits 205 support the sidewalls 145 and/or the upper wall 135 of the food shield 115. Using the conduits 205 as structural supports helps to hide the conduits 205 by incorporating them into the rest of the food service unit 100. In an exemplary embodiment, the conduits 205 are schedule 40 stainless conduits. Alternatively, the conduits 205 can be carbon steel or chrome plated conduits When the fire suppression system 125 is activated, the extinguishing agent stored in the tank 200 is provided to the nozzles 195 via the conduits 205. The extinguishing agent exits the nozzles 195 and is directed towards the cooking units 110 and the intake shroud 155 to extinguish any unwanted fire. The food shield 115 is integral to the functioning of the fire suppression system 125. The food shield 115 and the countertop 130 help to contain any unwanted fire within the space defined between the food shield 115 and the countertop 130. This containment helps to control any unwanted fires and makes it easier for the fire suppression system 125 to extinguish any unwanted fires. Also, the fire containment system is intended to protect a person near the food service unit 100 from both the fire and the extinguishing agent provided by the fire suppression system 125.

Also, when the fire suppression system is activated, the cooking units 110 are shut off, the fan 170 is shut off to inhibit additional air from being drawn into the recirculating ventilation system 120 and the recirculating ventilation system 120 is closed by a damper to inhibit any unwanted fire from exiting the recirculating ventilation system 120 via the exhaust vent 175. The damper is biased to a closed position (i.e., normally closed) and moves to an open position when the recirculating ventilation system 120 is on. The damper can be biased to a normally closed position by a spring or a solenoid. In an exemplary embodiment, the damper opens and closes the exhaust vent 175.

A fire detection sensor 210 detects the presence of unwanted fires. When the fire detection sensor 210 detects an unwanted fire, the fire suppression system 125 is activated. The fire detection sensor 210 can be a thermal fuse. The thermal fuse is positioned above the cooking units. In an exemplary embodiment, the thermal fuse is positioned near at least one of the nozzles 195. The thermal fuse is an electromechanical switch that breaks an electrical circuit when a meltable portion of the fuse melts, thereby disconnecting the remaining portions of the thermal fuse from each other. The remaining portions of the thermal fuse may be biased by a spring to ensure that they separate from each other. The meltable portion has a melting point that is indicative of an unwanted fire. In some embodiments, the melting point is around 165° Fahrenheit. In other embodiments, the melting point is around 500° Fahrenheit. In an exemplary embodiment, a single thermal fuse is used as the fire detection sensor 210. Alternately, more than one thermal fuse or other types of sensors capable of detecting a fire can be used.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure

What is claimed is:

1. A food service unit for use with a cooking unit, the food service unit comprising:

a food shield including an upper wall, a customer-side wall, and two lateral sidewalls, wherein the customer-side wall and the two sidewalls are arranged in a U-shape and the upper wall is coupled to upper portions of the customer-side wall and the two sidewalls, wherein the food shield provides a barrier separating a chef side of the food service unit from a customer side of the food service unit with the U-shape formed by the customer-side wall and the two sidewalls opening toward the chef side and the customer-side wall positioned toward the customer side;

a ventilation volume defined at least in part by the food shield;

a recirculating ventilation system including a filter, a fan downstream of the filter, and an exhaust vent, wherein the fan is configured to draw air from the ventilation volume through the filter and exhaust the air through the exhaust vent;

a low pressure sensor configured to detect when a differential pressure between atmosphere and a location between the filter and the fan is below a specified minimum pressure differential indicating a low air flow condition;

a high pressure sensor configured to detect when a differential pressure between atmosphere and the location between the filter and the fan is above a specified maximum pressure differential indicating an air flow blockage condition;

a control system configured to prevent a cooking unit from operating when the detected differential pressure is below the specified minimum pressure differential or above the specified maximum pressure differential;

a fire suppression system including a nozzle and a source of fire extinguishing agent; and a fire detection sensor configured to detect a fire and activate the fire suppression system when a fire is detected such that, upon activation of the fire suppression system, the extinguishing agent is dispensed through the nozzle.

2. The food service unit of claim 1, wherein the specified minimum pressure differential and the specified maximum pressure differential are representative of proper installation of the filter and representative of a prescribed level of cleanliness of the filter.

3. The food service unit of claim 2, wherein the fire suppression system further includes conduit fluidly coupling the nozzle to the source of fire extinguishing agent, and wherein the conduit is integrated into the food shield to provide structural support to the food shield.

4. The food service unit of claim 3, wherein the exhaust vent comprises a damper configured to close when a fire is detected by the fire detection sensor.

5. The food service unit of claim 4, wherein the recirculating ventilation system further includes an intake shroud and the filter comprises a grease filter positioned in the intake shroud.

6. The food service unit of claim 5, further comprising:

a particulate filter downstream of the grease filter.

7. The food service unit of claim 6, further comprising:

a charcoal filter downstream of the grease filter.

8. The food service unit of claim 1, wherein the fire suppression system further includes conduit fluidly coupling the nozzle to the source of fire extinguishing agent, and wherein the conduit is integrated into the food shield to provide structural support to the food shield.

9. A food service unit for use with a cooking unit, the food service unit comprising:

a fire suppression system including a nozzle, a source of fire extinguishing agent, and a plurality of conduit members fluidly coupling the nozzle to the source of fire extinguishing agent, wherein the conduit members form at least a portion of a frame;

a food shield supported at least in part by the frame of conduit members, wherein the food shield provides a barrier separating a chef side of the food service unit from a customer side of the food service unit;

a fire detection sensor configured to detect a fire and activate the fire suppression system when a fire is detected such that, upon activation of the fire suppression system, the extinguishing agent is dispensed through the nozzle;

a ventilation volume defined at least in part by the food shield;

a recirculating ventilation system including a filter, a fan downstream of the filter, and an exhaust vent, wherein the fan is configured to draw air from the ventilation volume through the filter and exhaust the air through the exhaust vent;

a pressure sensor configured to detect a differential pressure between atmosphere and a location between the filter and the fan; and a control system configured to prevent the cooking unit from operating when the detected differential pressure is outside a specified range of pressures.

10. The food service unit of claim 9, wherein the food shield comprises an upper wall, a customer-side wall, and two lateral sidewalls, wherein the customer-side wall and the two sidewalls are arranged in a U-shape and the upper wall is coupled to and supported by upper portions of the customer-side wall, the two sidewalls, and a plurality of the conduit members.

11. The food service unit of claim 10, wherein the nozzle is coupled to the upper wall.

12. The food service unit of claim 10, wherein the conduit is integrated into the food shield to provide structural support to the food shield.

13. The food service unit of claim 9, wherein the specified range of pressures are representative of proper installation of the filter and representative of a prescribed level of cleanliness of the filter.

14. The food service unit of claim 13, wherein the exhaust vent comprises a damper configured to close when a fire is detected by the fire detection sensor.

15. The food service unit of claim 14, wherein the recirculating ventilation system further includes an intake shroud and the filter comprises a grease filter positioned in the intake shroud.

16. A food service unit for use with a cooking unit, the food service unit comprising:

a food shield that defines a ventilation volume adjacent the cooking unit, wherein the food shield provides a barrier separating a chef side of the food service unit from a customer side of the food service unit;

a recirculating ventilation system including a filter, a fan downstream of the filter, and an exhaust vent, wherein the fan is configured to draw air from the ventilation volume through the filter and exhaust the air through the exhaust vent;

a low pressure sensor configured to detect when a differential pressure between atmosphere and a location between the filter and the fan is below a specified minimum pressure differential indicating a low air flow condition;

a high pressure sensor configured to detect when a differential pressure between atmosphere and the location between the filter and the fan is above a specified maximum pressure differential indicating an air flow blockage condition; and a control system configured to prevent the cooking unit from operating when the detected differential pressure is below the specified minimum pressure differential or above the specified maximum pressure differential.

17. The food service unit of claim 16, wherein the specified minimum pressure differential and the specified maximum pressure differential are representative of proper installation of the filter and representative of a prescribed level of cleanliness of the filter.

18. The food service unit of claim 17, further comprising:

a fire suppression system including a nozzle, a source of fire extinguishing agent, conduit fluidly coupling the nozzle to the source of fire extinguishing agent, wherein the nozzle is coupled to the food shield, and wherein the conduit is integrated into the food shield to provide structural support to the food shield; and a fire detection sensor configured to detect a fire and activate the fire suppression system when a fire is detected such that, upon activation of the fire suppression system, the extinguishing agent is dispensed through the nozzle.

19. The food service unit of claim 18, wherein the exhaust vent comprises a damper configured to close when a fire is detected by the fire detection sensor.

* * * * *